US006588740B2

(12) United States Patent
Brugger et al.

(10) Patent No.: US 6,588,740 B2
(45) Date of Patent: Jul. 8, 2003

(54) INTELLIGENT FEEDER

(75) Inventors: Charles E. Brugger, Rochester, NY (US); George Simmons, North Greece, NY (US); Stephen A. Horstman, Rochester, NY (US); Randall R. Maysick, Churchville, NY (US); Robert M. Westcott, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 47 days.

(21) Appl. No.: 09/734,453

(22) Filed: Dec. 11, 2000

(65) Prior Publication Data

US 2002/0105132 A1 Aug. 8, 2002

(51) Int. Cl.[7] ..... B65H 5/00

(52) U.S. Cl. ..... 271/10.03; 271/10.01; 271/10.02; 271/10.09; 271/225; 271/258.01; 271/265.01

(58) Field of Search ..... 271/10.01, 10.02, 271/10.03, 10.09, 225, 258.01, 265.01, 902, 263, 256.04, 266, 262

(56) References Cited

U.S. PATENT DOCUMENTS 4,140,390 A * 2/1979 Schultheis et al. ..... 355/29
5,129,642 A 7/1992 Svyatsky et al.
5,435,540 A * 7/1995 Martin et al. ..... 271/122
5,921,539 A 7/1999 Westcott et al.
5,966,559 A * 10/1999 May et al. ..... 399/303

OTHER PUBLICATIONS

Westcott et al. "Document Scanning System with Dockable Platen Flatbed Providing Sheet Fed and Platen Scanning Functions", U.S. patent application Ser. No. 09/618,739, (80599/NAB), filed Jul 18, 2000.

* cited by examiner

*Primary Examiner*—Eileen D. Lillis
*Assistant Examiner*—Michael Lowe
(74) *Attorney, Agent, or Firm*—The Harleston Law Firm

(57) ABSTRACT

An intelligent feeding and separating device for consistently separating an outermost sheet of media from a stack and feeding it to an imaging rendering apparatus, includes: a) a sheet transport mechanism; b) a feed device for feeding sheets to the sheet transport mechanism; c) a separation mechanism adjacent to the feed mechanism; d) at least one drive mechanism in operable association with the feed or separation mechanisms, and comprising a feed or separation roller reversal mechanism; e) a plurality of different types of sensor devices adjacent to the feed mechanism for measuring characteristics of the sheets being fed; and f) a microprocessor in communication with the sensor devices and the feed or separation roller direction reversal mechanism; wherein, depending upon input from the sensor devices, the microprocessor outputs to the feed or separation roller direction reversal mechanism to address feed-related problems encountered during operation.

11 Claims, 11 Drawing Sheets

INTELLIGENT FEEDER

FIELD OF THE INVENTION

The invention relates to a sheet feeding and separating device for use in an imaging transport apparatus, such as a document scanner, fax machine, or photocopier; more particularly to a sheet feeding and separating device with sensors for monitoring sheet feeding, and preventing sheet feeding and separating problems, such as multiple sheet feeding.

BACKGROUND OF THE INVENTION

Most conventional sheet feeding devices used in imaging apparatus, such as document scanners, fax machines, and photocopiers, rely on friction to feed sheets into the imaging apparatus. These sheet feeding devices generally include a driven feed roller with a high friction surface, which is intended to feed a single sheet from a media stack, and a separation pad or roller, which is intended to prevent all of the other sheets in the stack from also feeding through. However, misfeeds and multiple feeds do occur, which slows up the imaging transport process and causes problems for the operator of the apparatus.

Most sheet feeding devices are built with a particular set of parameters that govern feeding and separating functions of the device. These parameters can be optimized for only a limited range of sheet characteristics, such as friction. Unfortunately, successfully feeding hundreds or thousands of sheets into an imaging apparatus over time is not achieved by controlling one or two variables. Many sheet characteristics must be monitored and controlled in order to come close to error-free operation of a well-used imaging apparatus. Among the most common errors are multiple feeds, which are due to a sheet separating error, and sheet misfeeds, which are due to a feeding error.

Another sheet feeding problem occurs when the feeding device attempts to feed sheets that have been glued or taped together into the imaging apparatus. These sheets will not separate when they are fed. However, if they can be returned to the input area, the operator will be provided with an opportunity to separate them by hand.

Although a document and image scanner or other imaging apparatus may contain a means for detecting multiple feeds, it cannot actively reverse the unwanted sheets or actively change operating parameters. Such apparatus are only capable of stopping the document transport and/or alerting the operator when a multiple feed occurs.

Scanners with mechanisms for detecting multiple feeds normally only have one such mechanism. Such mechanisms for detecting multiple feeds accommodate only a specific subset of the range of documents which should be scanned. They generally cannot be relied upon to detect and avoid all, or even most, of the sheet feeding problems that arise in the course of using imaging apparatus.

The present invention is an intelligent document feeding and separating device for imaging apparatus, including document and image scanners, photocopiers, and fax machines, that is capable of determining when multiple sheets are being fed and remedying the problem. When multiple documents are being fed, this feeding device can automatically assess the problem and vary one or more of the parameters that govern the sheet singulation process in attempts to remedy the problem. The present device can reverse the feeding of problematic sheets or, optionally, all of the sheets in the feeder device. The present device actively monitors and adjusts governing parameters for the particular characteristics of the sheet(s) being fed, which greatly expands operating range. Feeding and separating errors are reduced and overall performance of the imaging apparatus is improved. The present device has expanded sensing capabilities so that it can more easily and clearly define and remedy the various feeding/separating problems commonly encountered in imaging apparatus.

The present invention also includes an intelligent method for feeding and separating sheets of media for an imaging apparatus. The method includes assessing the type of problem present (multiple feeds, misfeeds), reversing the feed roller direction, varying governing parameters, and repeatedly attempting to remedy the problem.

SUMMARY OF THE INVENTION

The present invention is a sheet feeding and separating mechanism for consistently separating an outermost sheet of media from a stack and feeding it to an imaging rendering apparatus, the feeding and separating device comprising:

a) sheet transport mechanism;

b) a feed mechanism for feeding sheets to the sheet transport mechanism, the feed mechanism being positioned so as to frictionally engage the outermost sheet of the stack to advance the sheet toward the sheet transport mechanism;

c) a separation mechanism positioned adjacent to the feed mechanism;

d) at least one drive mechanism in operable association with the feed or separation mechanisms for transmitting an intermittent drive force to the feed or separation mechanisms; and e) at least one sensor device for measuring the thickness or density of the sheet or sheets to be fed, the sensor device being positioned adjacent to the feed mechanism;

wherein at least one of the sensor devices inputs to the feeding and separating device, which is adjustable to address feed-related problems encountered during operation.

BRIEF DESCRIPTION OF THE DRAWINGS

A more complete understanding of the invention and its advantages will be apparent from the detailed description taken in conjunction with the accompanying drawings, wherein examples of the invention are shown, and wherein.

DETAILED DESCRIPTION OF THE INVENTION

Figure 1:
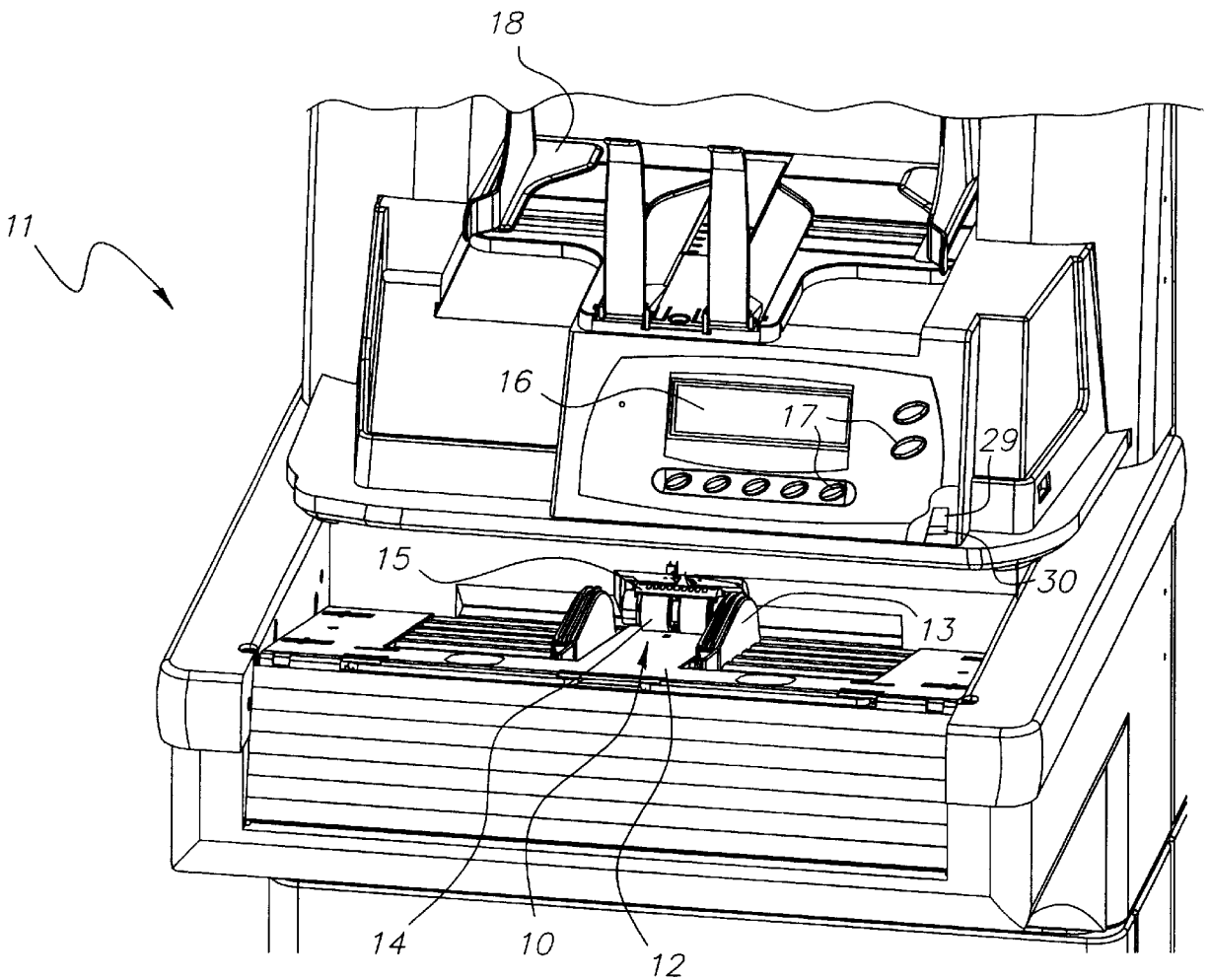
FIG. 1 is a front perspective view of a sheet feeding and separating device according to the present invention, shown in a printer.

In the following description, like reference characters designate like or corresponding parts throughout the several views. Also, in the following description, it is to be understood that such terms as "front," "above," "below," and the like are words of convenience and are not to be construed as limiting terms. Referring in more detail to the drawings, the invention will now be described.

Turning first to FIG. 1, a sheet feeding and separating device according to the present invention is generally designated by the numeral 10. The feeding/separating device is shown as part of a printer 11, although it is suitable for use in various other image rendering apparatus, such as scanners, fax machines, and photocopiers, for separating an outermost sheet from a stack of printable media and feeding it into the image rendering apparatus. Note that the term "image rendering apparatus" is meant to include image forming apparatus.

The preferred embodiment of a feeding and separating device 10 illustrated in FIG. 1 comprises: an input tray 12 (also called stack support), media adjustment guides 13 (also called paper side guides), urging rollers 14, and an urging roller case 15. Individual sheets of media, such as paper, report covers, or plastic overhead sheets, are ordinarily stacked on the input tray. The optionally adjustable media adjustment guides can be adjusted to accommodate non-standard sized media, such as postcards or envelopes. The feeding/separating device 10 optionally includes an information display screen 16, shown here above the feeding/separating device 10, for displaying information for the user, as well as several user input buttons 17 for the user to input commands into the feeding/separating device. An output stack support 18 at the top of the printer receives the sheets of media with completed images.

Figure 2:
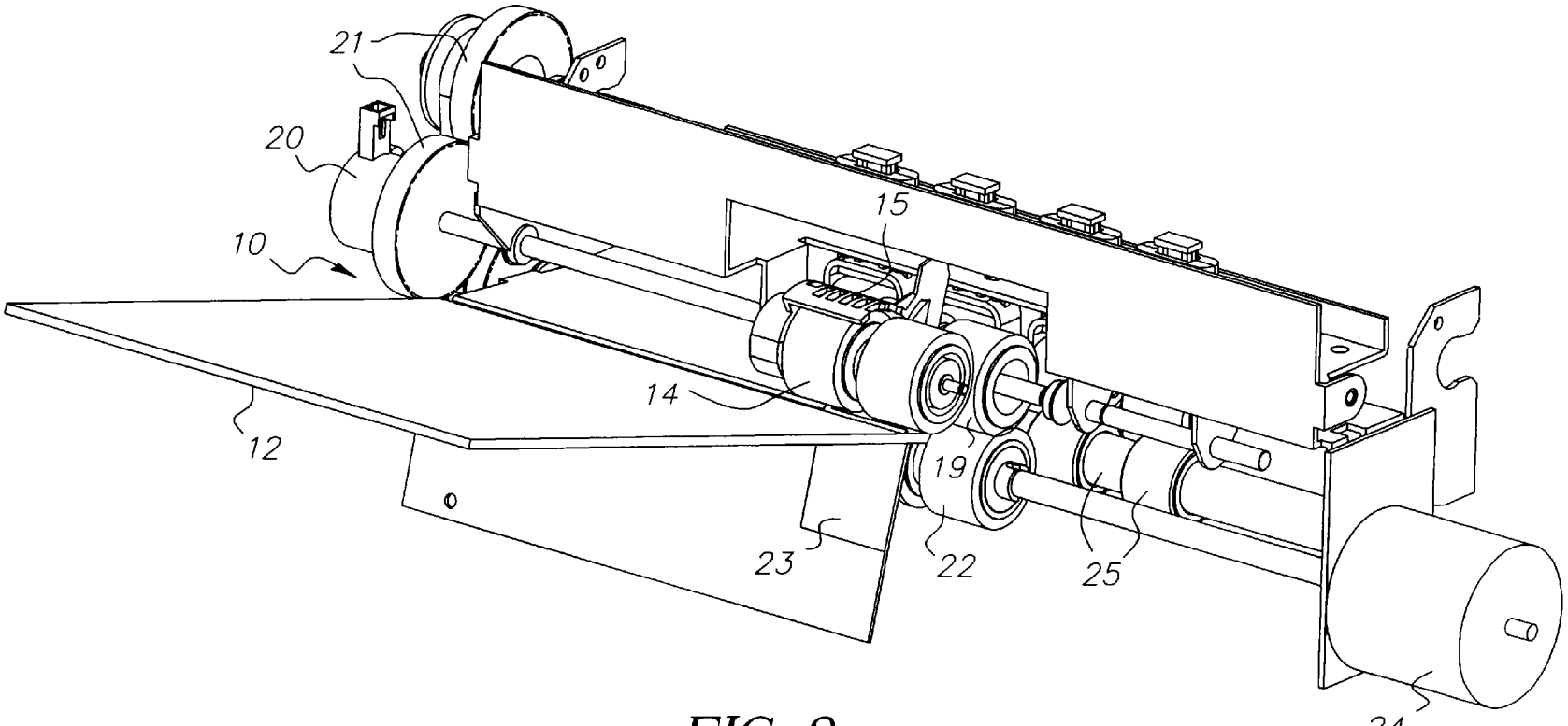
FIG. 2 is a perspective view of a sheet feeding and separating device according to the present invention.
Figure 3:
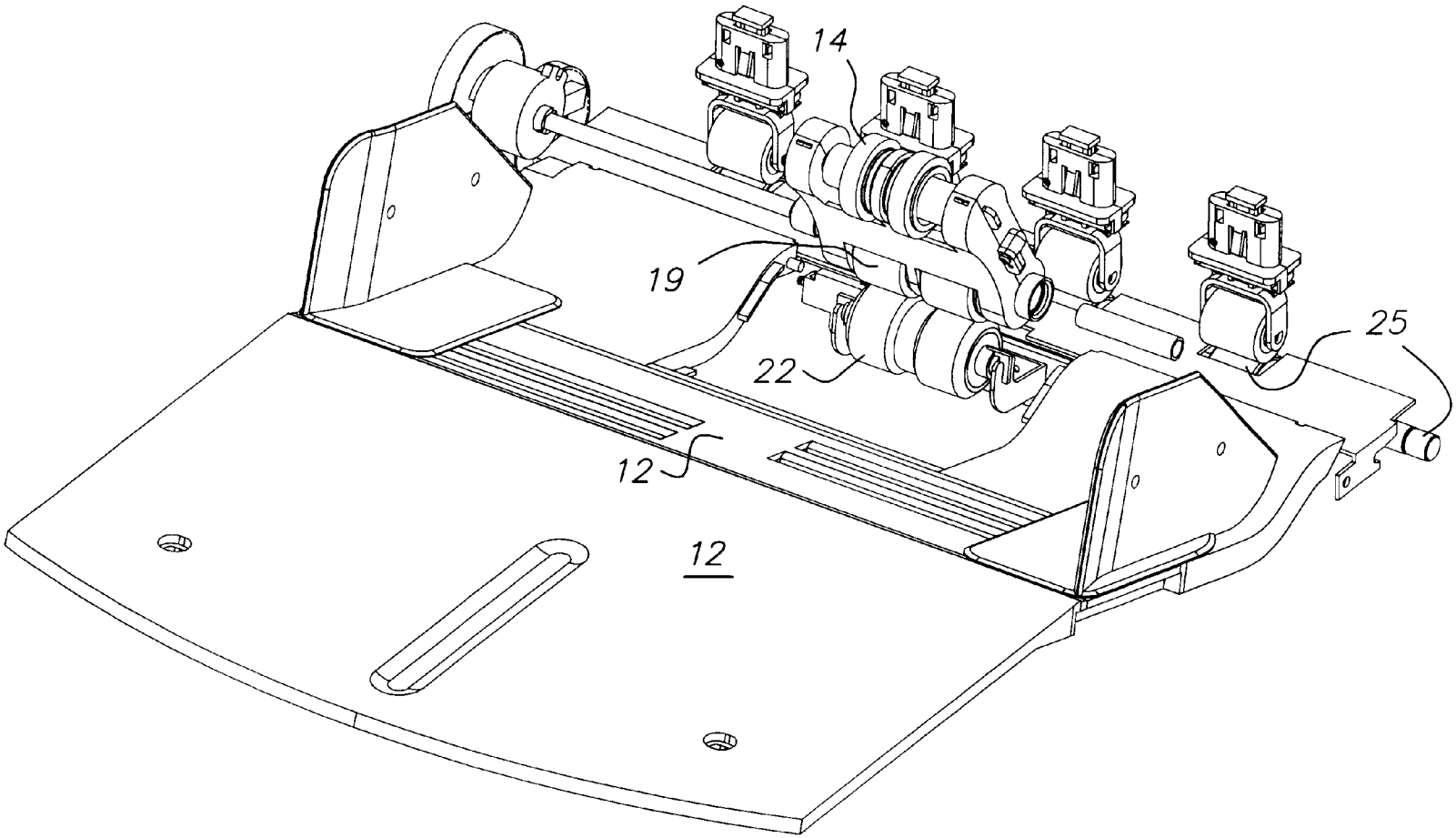
FIG. 3 is a perspective view of a sheet feeding and separating device according to the present invention.

Referring to FIGS. 2 and 3, a preferred embodiment of a feeding/separation device 10 includes: an input tray 12 (cutaway) which supports the stack of media, an urging roller 14 for pushing a sheet 28 of media from the stack into the device 10, an urging roller case 15 (cutaway) which covers the urging roller 14 and a feed roller 19 for feeding a single sheet to the image rendering apparatus, a feed roller clutch 20 and feeder drive gears 21 for driving the feed roller, a separation roller 22 positioned under the feed roller for separating sheets 28, a separation roller door 23 (cutaway) which covers the separation roller 22, a separation roller drive motor 24 for rotating the separation roller 22, and a takeaway shaft/roller 25 for moving the sheet away. A preferred embodiment of the present invention includes a sheet transport mechanism, a feed mechanism, a separation mechanism, a clutch mechanism, a mechanism for displaying to a user, and a mechanism for adjusting the device 10 according to input from sensors within the device. The feed mechanism feeds the uppermost sheet from the media stack, which is normally held on an input tray 12, into the sheet transport mechanism. The feed mechanism most preferably includes an urging roller 14 and a feed roller 19 positioned so as to frictionally engage the uppermost sheet and advance it to the sheet transport mechanism.

As shown in FIGS. 2 and 3, a separation mechanism is detachably mounted to the printer housing using a support mechanism. The separation mechanism, preferably a roller 22, is positioned adjacent to the feed mechanism, preferably a roller 19, so as to define a nip between them. A sheet transport mechanism for receiving the uppermost sheet from the feed mechanism is attached to the printer housing. A sheet path is preferably defined between the separation mechanism and the feed mechanism, and the housing.

A drive mechanism for driving the feed module is also mounted in the housing. There is preferably a clutch mechanism connected to the drive mechanism for transmitting an intermittent drive force to the feed module. Preferably, the housing defines an indent for housing the feed module adjacent to the input tray. The indent is flanked by portions of the housing defining a drive shaft support mechanism, and a support shaft support mechanism.

As shown in FIGS. 2 and 3, the feed module preferably comprises the urging roller/feed roller case 15. It is designed to hold at least one urging roller and at least one feed roller and prevents dust from accumulating on the feed roller shaft. The urging mechanism preferably has at least one urging roller positioned on an urging roller hub having a first one way bearing positioned therein, and mounted on an in-feed shaft. The in-feed shaft has a first end and a second end, and an in-feed gear positioned near the first end of the in-feed shaft. The second end rests in the first bearing formed by the feed module housing, and the first end of the in-feed shaft rests in the second bearing formed by the feed module housing.

The feed mechanism preferably comprises at least one feed roller positioned on a feed roller hub having a second one way bearing positioned therein. At least one feed roller is mounted on a feed roller shaft. Preferably, the feed roller shaft has a first end and a second end. The first end is attached to a self-centering coupling gear that is in operable association with a drive shaft. Preferably an idler gear is positioned between and in operable association with the in-feed gear and the self-centering coupling gear to transfer the drive from the self-centering coupling gear to the in-feed gear. The second end of the feed roller shaft preferably has a self-centering support hub mounted thereon. The self-centering support hub is received by a movable support shaft having a compression spring mounted thereon. The movable support shaft is biased by the compression spring toward the self-centering support hub. The drive shaft is rotatably carried by the drive shaft support means and the movable support shaft is rotatably carried by the support shaft support means.

Figure 4:
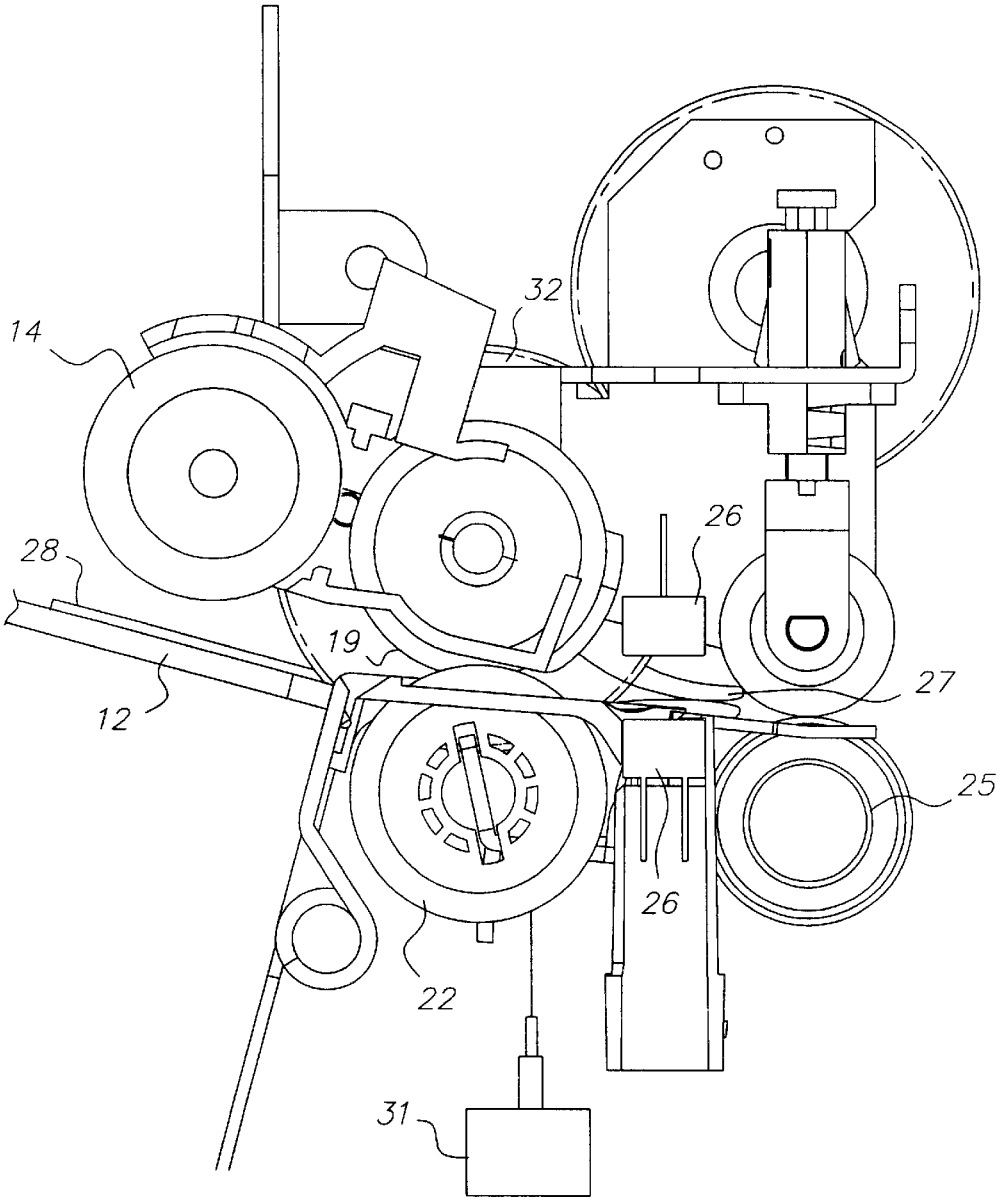
FIG. 4 is a cross sectional view of a sheet feeding and separating device according to the present invention.

Referring to FIG. 4, a latitudinal cross-section of the device taken across the approximate center of the device shows an input tray 12, an urging roller 14, a feed roller 19, a separation roller 22, and a takeaway roller 25. These define a passageway through which the media sheet, or document, passes. The feeding/ separating device 10 further comprises at least one type of sensor device for measuring physical characteristics of the sheet or sheets to be fed, particularly thickness and/or density of the sheet(s). The sensor device is preferably positioned adjacent to the feed mechanism. As shown in FIG. 4, an ultrasonic sensor emitter-detector pair 26 is positioned above and below the passage to receive electronic signals defining the characteristics of the sheet passing by or between them. At least one thickness sensor 27 measures the thickness of the sheet passing by the sensor, which can help to signal a multiple feed problem.

The feed/separation device 10 also preferably includes a microprocessor 29 in operable communication with the sensor device(s) for comparing and recording measurements from the sensor device(s), as well as memory 30 in association with the microprocessor for storing such measurements, as depicted in the cutaway of FIG. 1. Extended memory 30, such as BEPROM, EPROM, or PROM, may be included in the present device to allow extensive data storage. The microprocessor can be located at any suitable location in the device, as long as it is in communication with the sensors.

The microprocessor is programmed to quickly effect pre-programmed responses within the intelligent feed/separation device 10, depending on the particular irregularity taking place. The responses adjust the device to compensate for the irregularity (problem), or they shut the system down and notify the operator. Output to a display screen notifies the operator of the specific problem. By reducing shutdowns due to multiple feed problems and the like, time is saved in the long run and user frustration is reduced. For example, a thickness sensor measurement over a pre-programmed, specified level would trigger the separation roller to briefly reverse the direction of rotation. If the problem is not resolved, the microprocessor would input to the display screen, giving a specific command to alert the operator to the problem. The present system can optionally be re-programmed, or settings can be changed to accommodate different type media, such as envelopes, heavier paper, etc., or conditions, such as high humidity.

In use, at least one urging roller 14 picks up the outermost sheet from the stack (not shown) on the input tray 12 and urges it down a passage toward at least one feed roller 19. The sheet is rolled between a feed roller 19 and a separation roller 22, which are shown in FIG. 4. The document then passes by at least one ultrasonic sensor 26 and at least one thickness sensor 27. The sensors feed information to an information storage and retrieval system, preferably a microprocessor with memory (not shown). The sheet is then moved away by at least one takeaway roller 25.

Figure 5:
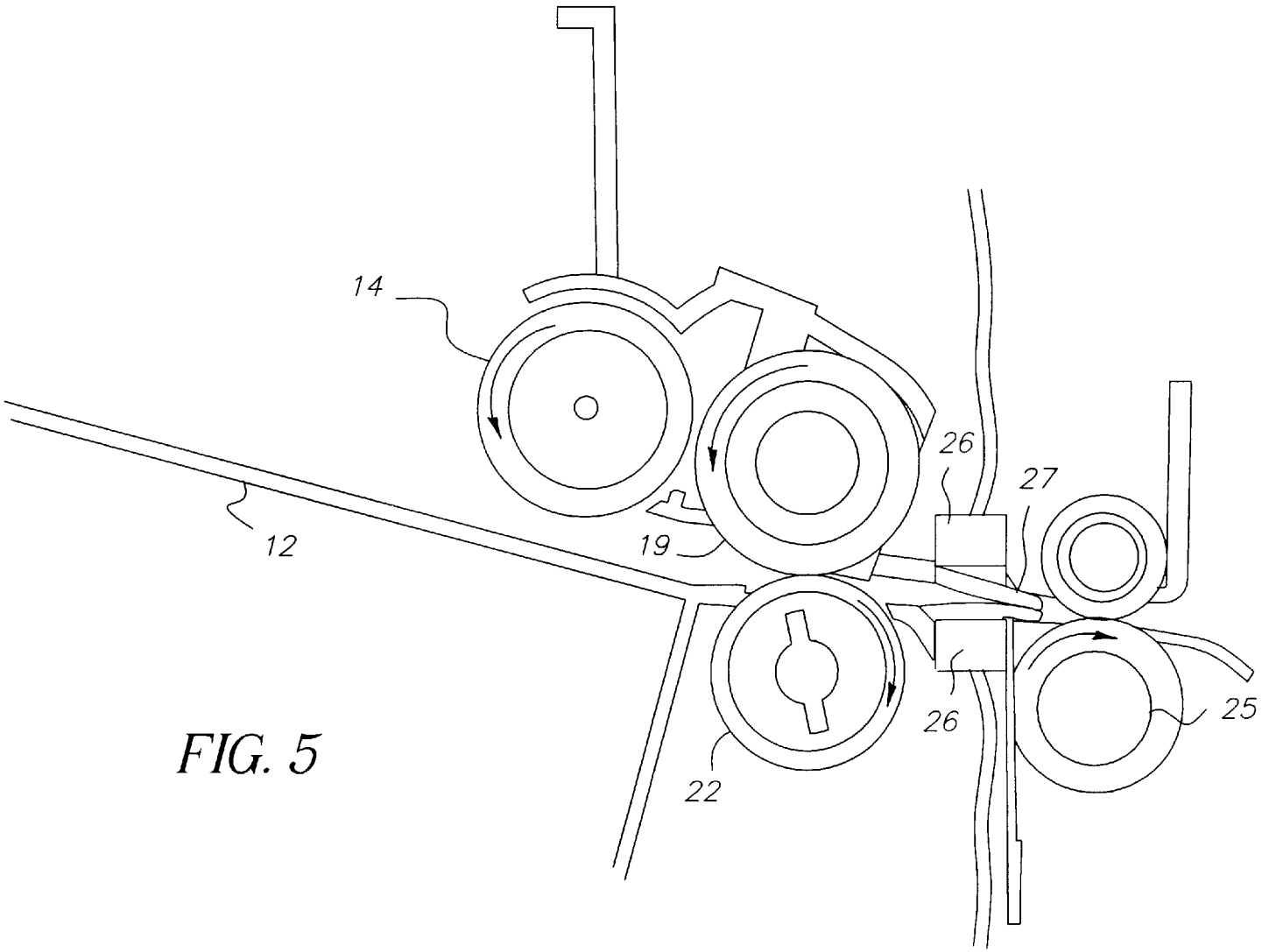
FIG. 5 is a simplified cross-sectional view of a sheet feeding and separating device according to the present invention, showing a normal operation.

Referring to FIG. 5, a simplified cross view of a feeding/separating device 10 indicates the direction of rotation of the four types of rollers during normal operation. The device includes the urging roller 14 positioned over an end of the input tray 12. The urging roller 14 precedes the feed roller 19, which is positioned above a separation roller 22. These rollers precede the ultrasonic sensors 26, and a thickness sensor 27. Last along the passageway is the takeaway roller 25. The arrows indicate the direction of movement of the rollers. In FIG. 5, the urging roller and the feed roller rotate in a counterclockwise direction. Where there is one sheet, or no sheets, passing by the separation roller 22, it rotates in a clockwise direction, as shown in FIG. 5. This directs movement of the sheet between the feed roller above the sheet and the separation roller beneath the sheet. The takeaway roller 25 rotates in a clockwise direction.

Figure 6:
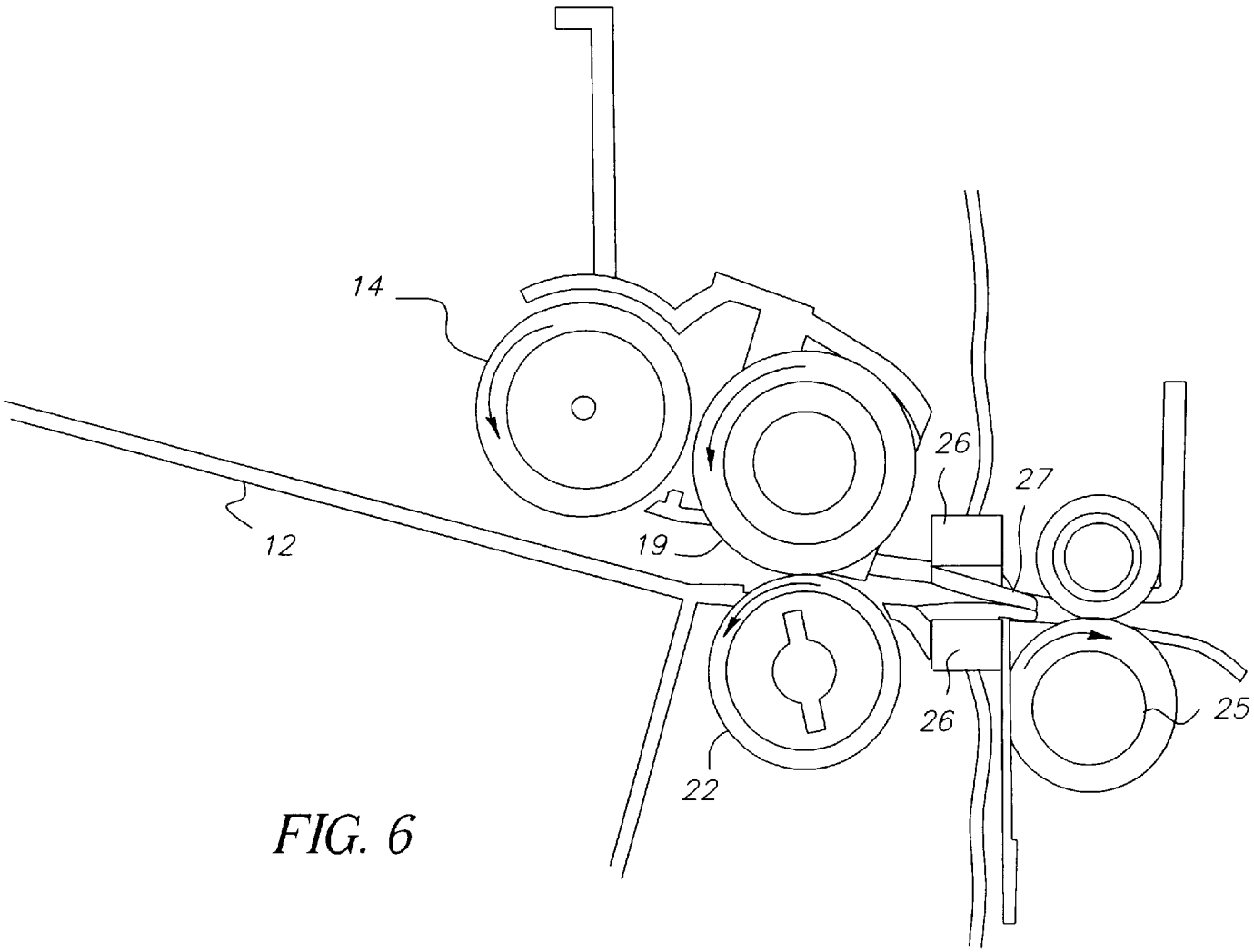
FIG. 6 is a simplified cross-sectional view of a sheet feeding and separating device according to FIG. 5, showing a roller reversing operation.

The same view is shown in FIG. 6, except that rotation of the rollers during a multiple feed problem is depicted. Here, the rollers rotate in the same direction as during normal operation, but the feed/separation device has detected the multiple feed problem and automatically reversed rotation of the separation roller. The sensors have received input indicating a higher than permissible thickness or density for the sheet or sheets in the passage at the time. The separation roller 22 rotates counterclockwise, which often results in the resolution of the multiple feed problem. The feed/separation device can be programmed to adjust governing parameters, based on input over time from the sensors, to compensate for conditions on a particular feed/separation device for an image rendering apparatus.

Figure 7:
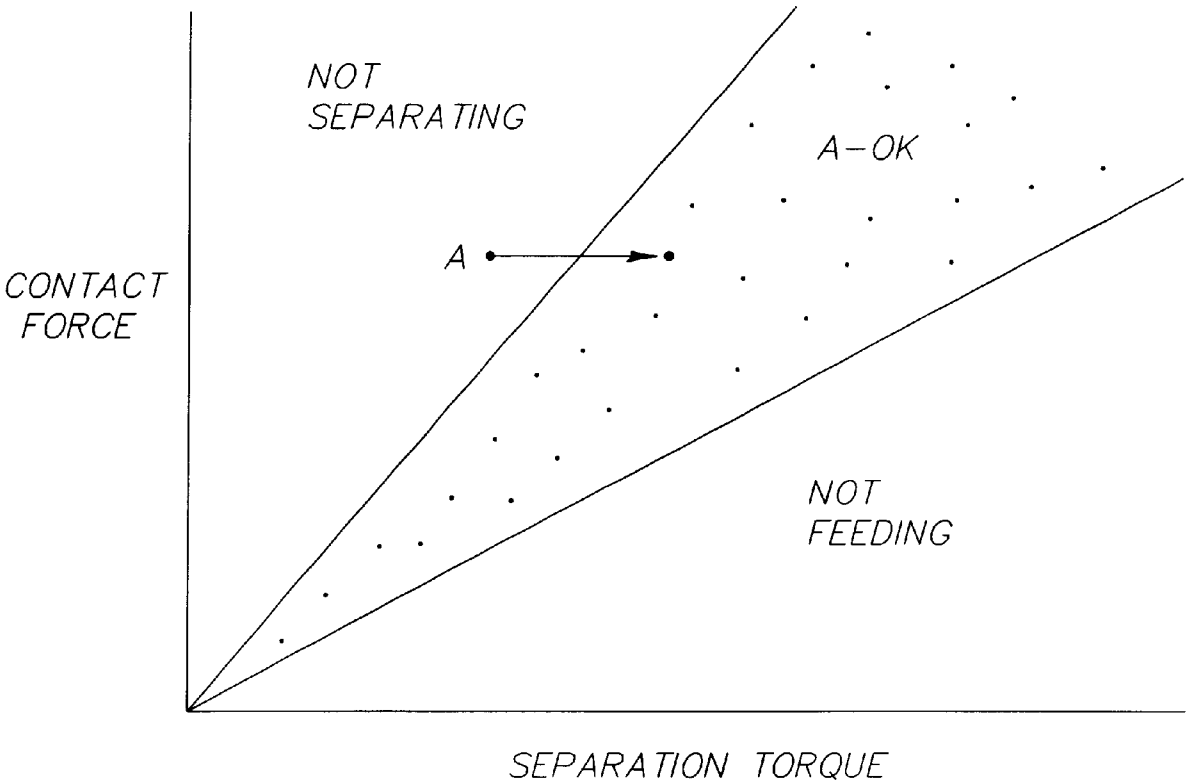
FIG. 7 is a graph showing separation roller torque versus roller contact force.

FIG. 7 is a graph depicting interaction (two sheet separation) of two of the governing parameters of importance herein: separation roller torque (X-axis) and roller contact force (Y-axis). This represents a frequent situation with most common sheet types. The gray area represents the combinations of contact force and separation torque that will result in acceptable feeding and separation of the sheets ("A-OK"). As the friction of the sheets increases, however, the boundaries of this area rotate clockwise about the origin, and the original combination of feed/separation device parameters will then be outside the acceptable area. Importantly, the feed/separation device can then change its parameters to reposition its operating point within the operating area. To the left of the gray area in FIG. 7, the problematic sheets do not separate. To the right of the gray area (and below), the problematic sheet will not feed through the feed/separation device.

Generally, separation occurs when a plurality of sheets enter the contact area between the feed and separation rollers and the sheet in contact with the feed roller is driven inward and the sheet(s) in contact with the separation roller are held by it. The sensor(s) in the feed/separation device determine when multiple sheets are being fed into the scanner. Use of multiple sensor technologies allow better discrimination of the nature of the document(s) being fed. When separation does not completely occur, as determined by the sensor(s), changes are made to one or more of the parameters that govern the sheet singulation process. The governing parameters are adjusted according to the characteristics of the fed sheets, and then the operating range is shifted toward what is needed for the particular set of sheet characteristics.

The separation roller 22 is set against the feed roller 19 with a certain level of force. The feed roller rotates in a direction inward to the scanner or the like to feed sheets into it. The separation roller can be driven in the reverse direction with a controlled amount of torque. If the drive connection to the feed roller is interrupted, the feed roller will be triggered to rotate in the reverse direction by the separation roller, or it can also be driven in reverse by a reverse drive mechanism 31 (see FIG. 4). In the latter case, the microprocessor 29 recognizes resolution of the feed problem by detecting the presence of a single sheet, and automatically halts the reverse drive mechanism 31, and re-commences the primary drive mechanism. With the former drive interruption mechanism 32, the microprocessor recognizes a misfeed or multiple feed, and halts the feed roller, whereupon continued rotation of the adjacent separation roller automatically reverses the feed roller direction. Once the microprocessor automatically recognizes resolution of the multiple feed or misfeed through continued sensor input, it signals the drive interruption mechanism 32, which restores the drive connection and re-commences rotation of the feed roller 22. Where the feed-related problem is not resolved after repeated returns of the misfed or multiple sheets to the input tray 12, the microprocessor 29 signals an alarm within the apparatus to sound or a message to be displayed in the information display screen.

The flow of the problematic sheets is reversed until the feed/separation device determines that only a single sheet is being fed, based on input from the sensor(s). If the drive connection to the feed roller is deliberately interrupted, all of the sheets in the feeder will be reversed. Reversal of the unwanted sheets, or of all the sheets, provides the feed/separation device another opportunity to separate those sheets. When sheets that are glued or taped together are fed, they will not separate. With the present device, such sheets are repeatedly returned to the input tray, and consequently would not be fed. The operator can be alerted by an alarm and/or a message in an information display window.

Redundant sensors are preferred for use herein because they provide added assurance of detecting multiple feeds. For example, sheets that are glued or taped together may not register as multiple sheets to a sensor that operates by detecting an excessive number of sheet surfaces. However, they would register to a sensor that determines excessive sheet thickness. On the other hand, a sensor that detects thickness may not be reliable while scanning a batch of documents of mixed thickness. Such a sensor may miss multiple thin documents, or register a false alarm with thicker documents. A sensor that detects surfaces will be more reliable in that application. All types are preferred for use herein.

Figure 8:
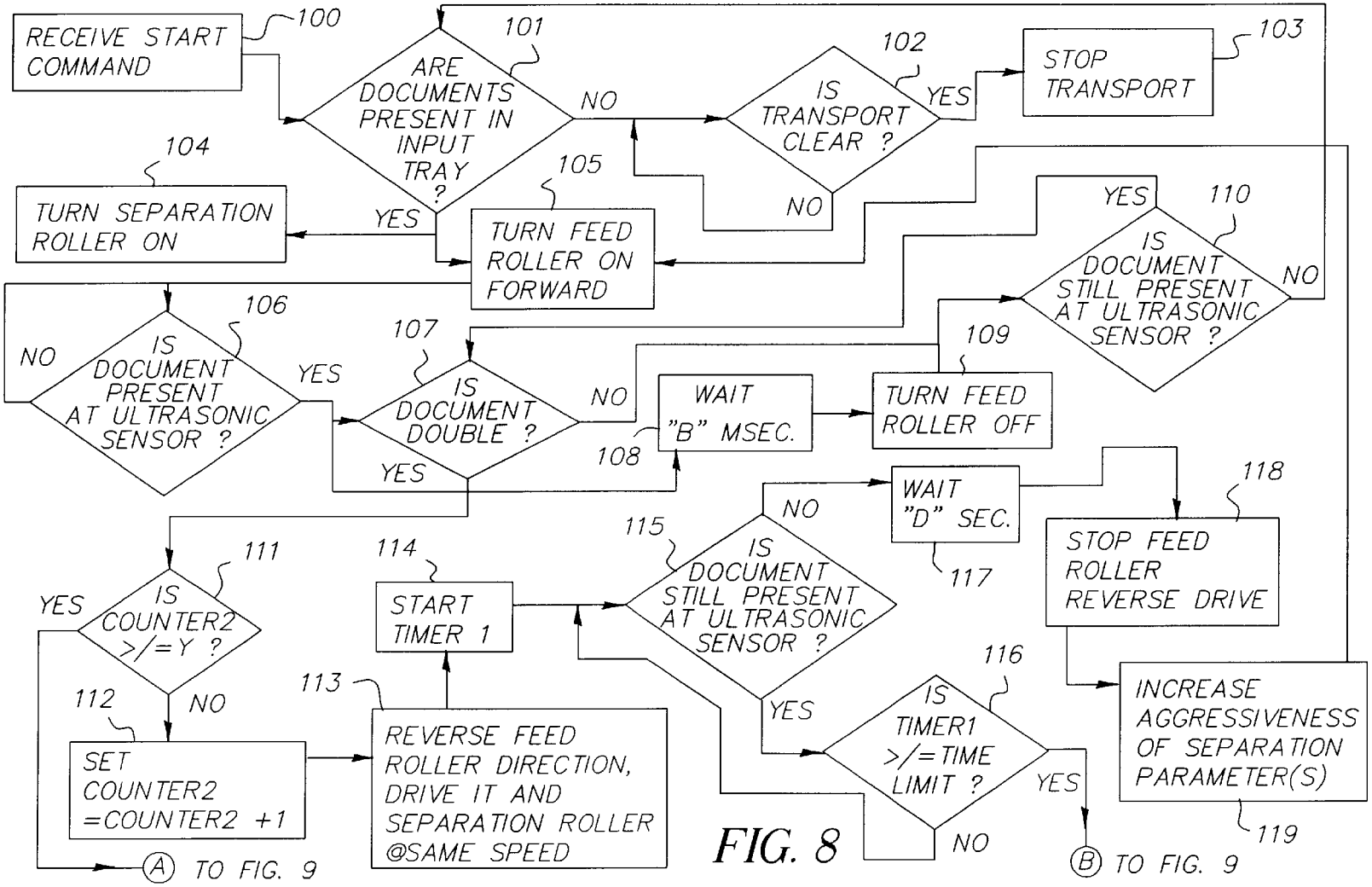
FIG. 8 is a flowsheet showing a method for sheet feeding and separating according to the present invention.
Figure 9:
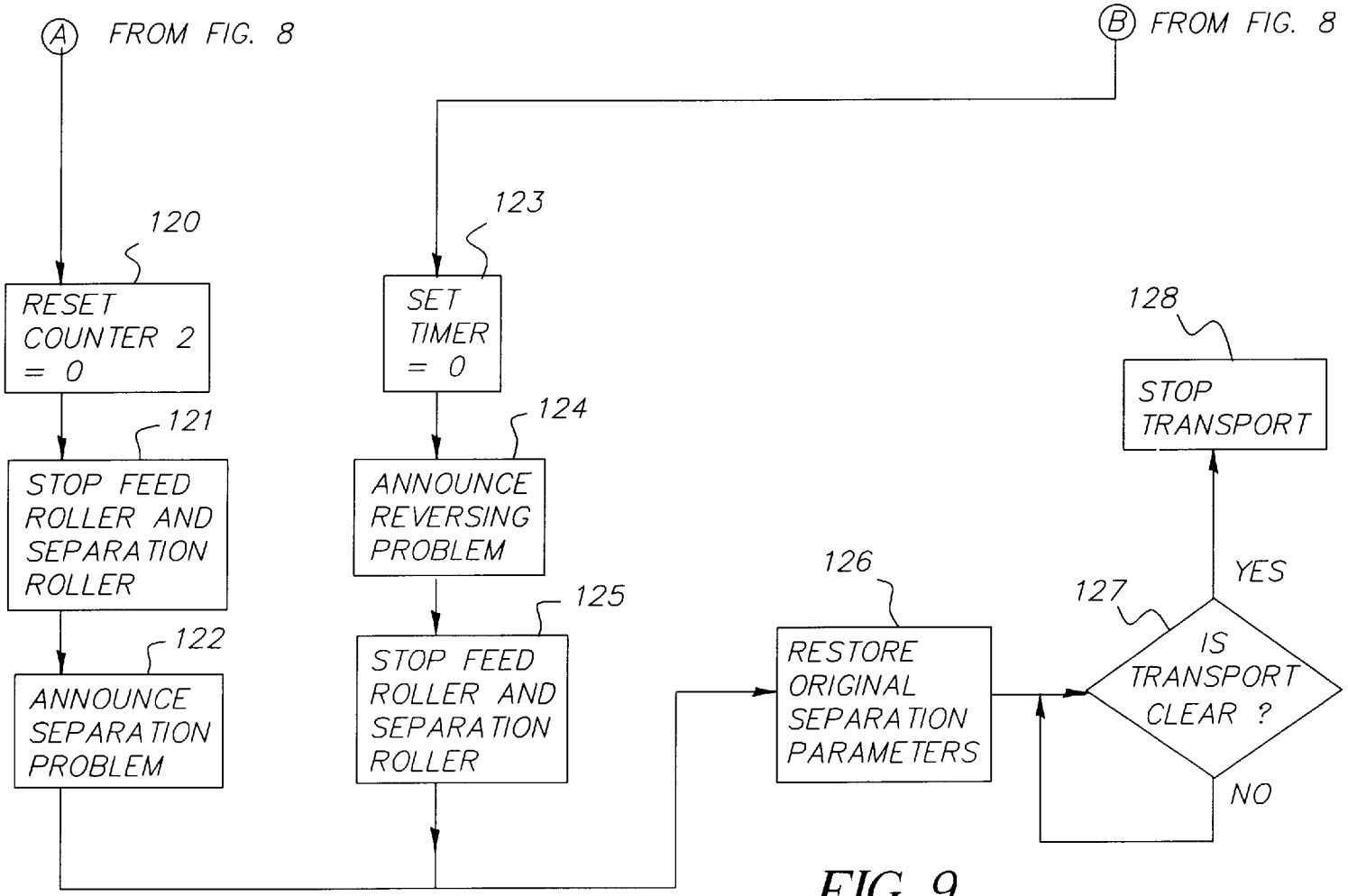
FIG. 9 is a flowsheet showing a continuation of the method shown in FIG. 8.

Also included in the present invention is a method for feeding sheets of media, or documents, to an image rendering apparatus, such as a document scanner, fax or photocopier. As illustrated in the flowchart of FIG. 8, a preferred method comprises the following steps:

1) Initiating the present process, upon receiving a start command, as shown in Block 100;

2) Sensing whether a document is present in an input tray to the image rendering apparatus, as shown in Block 101;

3) If documents are not present in the input tray, sensing whether the transport is clear, as shown in Block 102; and 4a) If the transport is clear, stopping the transport, as shown in Block 103; or 4b) If the transport is not clear, rechecking whether the transport is clear, as shown in Block 102; or 5) If documents are present in the input tray, turning a separation roller on, as shown in Block 104; and turning a feed roller on forward, as shown in Block 105; and 6) Sensing whether there is a document present at an ultrasonic sensor, as shown in Block 106; and 7a) If the sensor indicates that there is no document present, rechecking whether there is a document present at the ultrasonic sensor, as shown in Block 106; or 7b) If the sensor indicates that there is a document present at the ultrasonic sensor, sensing whether there are double documents (i.e., one sheet of media behind another), present at the ultrasonic sensor, as shown in Block 107; or 8) Waiting "B" milliseconds, or a sufficient amount of time for a lead edge of the document to be fixed between two takeaway rollers, as shown in Block 108, and then turning the feed roller off, as shown in Block 109;

9) Sensing whether the document is still present at the ultrasonic sensor, as shown in Block 110;

10a) If the document is still present at the ultrasonic sensor, rechecking whether there are double documents, as shown in Block 107, and returning to Step 7b; or 10b) If the ultrasonic sensor detects that there is no document present, returning to Step 2: sensing whether documents are present in the input tray, as shown in Block 101;

11) If the documents are not double, as shown in Block 107, sensing whether the document is still present at the ultrasonic sensor, as shown in Block 110;

12a) If the ultrasonic sensor detects that there is no document present, returning to Step 2: sensing whether documents are present in the input tray, as shown in Block 101;

12b) If the document is still present at the ultrasonic sensor, rechecking whether there are double documents, as shown in Block 107, and returning to Step 7b; and 13) If there are double documents present at the ultrasonic sensor, assessing whether a counter 2 measurement is more than or equal to Y, where Y is a pre-set maximum number of tries before backing up and trying again, as shown in Block 111; and 14a) If the counter 2 measurement is more than or equal to Y, continuing with FIG. 9 "C" (Step 19); or 14b) If the counter 2 measurement is less than Y, setting the counter 2 limit to equal counter 2 plus one, as shown in Block 112; and reversing the feed roller direction and driving it while maintaining the separation roller at substantially the same speed, as shown in Block 113; and starting timer 1, which is for reversing timeout limit, as shown in Block 114;

15) Sensing whether the document is still present at the ultrasonic sensor, as shown in Block 115;

16) If the document is still present at the ultrasonic sensor, assessing whether a timer 1 measurement is more than or equal to a pre-set time limit, as shown in Block 116;

17a) If the timer 1 measurement is more than or equal to the pre-set time limit, proceeding to FIG. 9 "D" (Step 20);

17b) If the timer 1 measurement is less than the pre-set time limit, returning to Step 15: sensing whether the document is still present at the ultrasonic sensor, as shown in Block 115;

18) If there is no document present at the ultrasonic sensor, waiting "D" seconds, where "D" seconds is long enough to back up the lead edge of the document behind the separation roller, as shown in Block 117; stopping the feed roller, and reversing drive, as shown in Block 118; and increasing the separation parameter or parameters, as shown in Block 119, then returning to Step 5: turning a feed roller on in a forward direction, as shown in Block 105;

Turning now from FIG. 8 to FIG. 9:

19) Continuing from Block 111 in FIG. 8 "C", if the counter 2 measurement is more than or equal to Y, resetting the counter 2 limit equal to zero, as shown in Block 120; stopping the feed roller and the separation roller, as shown in Block 121; and announcing the separation problem, as shown in Block 122; or 20) Continuing from Block 116 in FIG. 8 "D", if the timer 1 measurement is more than or equal to the time limit, setting the timer 1 limit equal to zero, as shown in Block 123; announcing a reversing problem, as shown in Block 124; and stopping the feed roller and the separation roller, as shown in Block 125; and 21) Restoring the original separation parameters, as shown in Block 126;

22) Checking whether the transport is clear, as shown in Block 127;

23a) If the transport is not clear, rechecking whether the transport is clear, as shown in Block 127; or 23b) If the transport is clear, stopping the transport, as shown in Block 128.

With the above-described, preferred method, when multiple documents are detected by the ultrasonic sensor, the whole problematic group of documents is returned to the input tray, the separation parameters are automatically reset, and the feeding/separating process is attempted again with more aggressive separation parameters. While many conventional feed/separation methods often fail with very fast image transport apparatus, such as high speed copiers, the present method is effective in preventing feed/separation problems and will minimize work stoppages due to feed-related problems in such apparatus.

Figure 10:
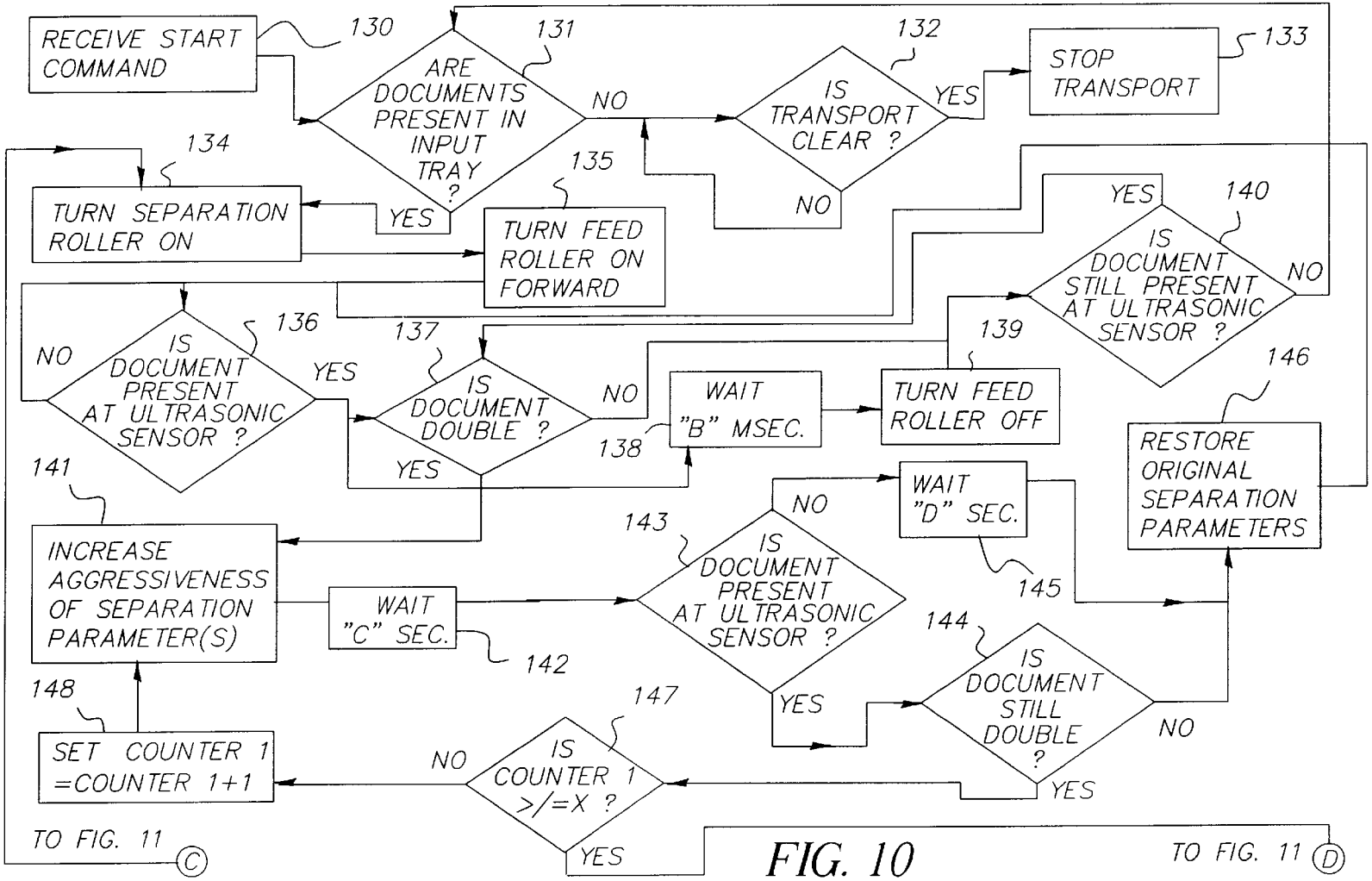
FIG. 10 is a flowsheet showing an alternate embodiment of a method for sheet feeding and separating according to the present invention.
Figure 11:
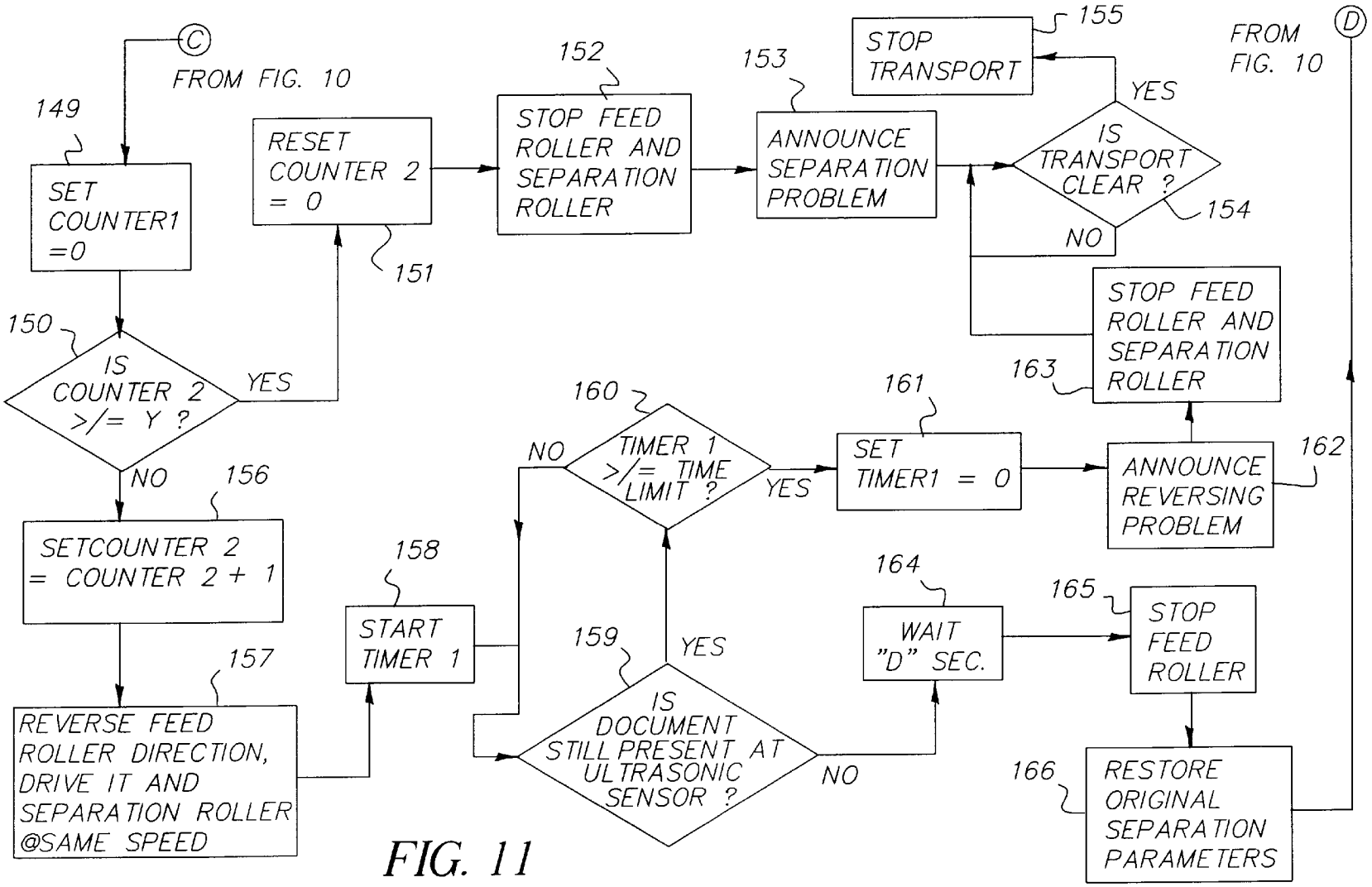
FIG. 11 is a flowsheet showing a continuation of the method shown in FIG. 10.

An alternate embodiment according to the present invention is described below. This method provides sufficient time after the documents reach the ultrasonic sensor, and before they are transported to the takeaway rollers, to allow more aggressive attempts to separate them before returning the whole problematic group of documents to the input tray to try again. This method requires either a sufficiently long distance between the feeder roller(s) and the takeaway rollers, or a sufficiently slow transport speed. As shown in FIG. 10, this alternate method for feeding sheets of media, or documents, to an image rendering apparatus comprises the following steps:

(1) Initiating the present process, upon receiving a start command, as shown in Block 130;

(2) Sensing whether a document is present in an input tray in the feeding and separating device, as shown in Block 131;

(3) If documents are not present in the input tray, sensing whether the transport is clear, as shown in Block 132; and (4a) If the transport is clear, stopping the transport, as shown in Block 133; or (4b) If the transport is not clear, rechecking whether the transport is clear, as shown in Block 132; or (5) If documents are present in the input tray, turning a separation roller on, as shown in Block 134; and then turning a feed roller on in a forward direction, as shown in Block 135; and (6) Sensing whether there is a document present at an ultrasonic sensor in the feeding and separating device, as shown in Block 136; and (7a) If there is no document present at the ultrasonic sensor, turning the feed roller on forward, as shown in Block 135; or (7b) If the sensor indicates that there is a document present at the ultrasonic sensor, sensing whether there are double documents (i.e., one sheet of media behind another), present at the ultrasonic sensor, as shown in Block 137; or (8) Waiting "B" milliseconds, or long enough to get a lead edge of the document into the takeaway rollers, as shown in Block 138, and then turning the feed roller off, as shown in Block 139; and (9) Sensing whether the document is still present at the ultrasonic sensor, as shown in Block 140; and (10a) If the document is still present at the ultrasonic sensor, rechecking whether there are double (more than one) documents, as shown in Block 137, and continuing from Step 7b; or (10b) If the ultrasonic sensor detects that there is no document present, returning to Step 2: sensing whether documents are present in the input tray, as shown in Block 131;

(11a) If there is only one document, as shown in Block 137, sensing whether the document is still present at the ultrasonic sensor, as shown in Block 140, and returning to Step 9 above;

(11b) If there is more than one document present, increasing the separation parameter(s), as shown in Block 141;

(12) Waiting "C" seconds, or a sufficient amount of time to back up the lead edge of the document behind the sensor, as shown in Block 142;

(13) Sensing whether there is a document present at the ultrasonic sensor, as shown in Block 143;

(14a) If there is a document present at the ultrasonic sensor, sensing whether there is more than one document present, as shown in Block 144; or (14b) If there is no document present at the ultrasonic sensor, waiting "D" seconds, or a sufficient amount of time for a lead edge of the document to be backed behind the separation roller, as shown in Block 145;

(15) Restoring original separation parameters(s), as shown in Block 146;

(16) Returning to Step 6: sensing whether there is a document present at the ultrasonic sensor, as shown in Block 136;

(17) If there are still double documents (Block 144), assessing whether counter 1 is more than or equal to X, where X is the number of tries to increment separation parameters, as shown in Block 147;

(18a) If counter 1 is less than X, setting counter 1 equal to counter 1 plus one, as shown in Block 148; and returning to Step 11b: increasing separation parameter (s), as shown in Block 141;

(18b) If counter 1 is more than or equal to X, proceeding to FIG. 11 "E" (Step 19).

Referring now to FIG. 11 "E":

(19) Setting counter 1 equal to zero, as shown in Block 149;

(20) Assessing whether counter 2 is more than or equal to Y, where Y is the maximum number of tries to back up and try again, as shown in Block 150;

(21) If counter 2 is more than or equal to Y, resetting counter 2 to equal zero, as shown in Block 151;

(22) Stopping the feed roller and the separation roller, as shown in Block 152;

(23) Announcing a separation problem, as shown in Block 153;

(24) Sensing whether the transport is clear, as shown in Block 154;

(25a) If transport is not clear, recheck whether transport is clear, as shown in Block 154;

(25b) If transport is clear, stopping transport, as shown in Block 155;

(26) If counter 2 is less than Y, setting counter 2 equal to counter 2 plus one, as shown in Block 156;

(27) Reversing feed roller direction, and driving the feed roller and the separation roller at substantially the same speed as each other, as shown in Block 157;

(28) Starting timer 1, which is for reversing timeout limit, as shown in Block 158;

(29) Sensing whether there is a document still present at the ultrasonic sensor, as shown in Block 159;

(30) If there is a document still present at the ultrasonic sensor, assessing whether the timer 1 measurement is more than or equal to a pre-set time limit, as shown in Block 160;

(31a) If the timer 1 measurement is less than the time limit, rechecking whether the document is still present at the ultrasonic sensor, as shown in Block 159;

(31b) If the timer 1 measurement is more than or equal to the pre-set time limit, setting timer 1 equal to zero, as shown in Block 161; announcing a reversing problem, as shown in Block 162; and stopping the feed roller and the separation roller, as shown in Block 163; then returning to Step 24 (Block 154);

(32) If the document is not still present at the ultrasonic sensor (Block 159), waiting "D" seconds, or long enough to back up the document's lead edge behind the separation roller, as shown in Block 164; stopping the feed roller, as shown in Block 165; and restoring original separation parameter(s), as shown in Block 166; then returning to Step 5: turning the separation roller on (Block 134), which is "F" on the previous Figure, FIG. 10.

Both methods described herein provide for sensing the presence of documents in the input tray prior to initiating the feeding operation, and for stopping the feeding operation when the input tray is empty. Both allow documents unaffected by a multiple feed problem to clear out of the transport before stopping the transport in an effort to correct a multiple feed problem. In both embodiments of the method, the ultrasonic sensor is used to detect the presence of documents between the feed roller and the takeaway roller, in order to determine whether the document is on its way to the transport and to assure that it is reversed when expected to do so. The feed roller and the separation roller must be reversed at substantially the same speed in order to avoid placing the lead edges of the documents in a disadvantageous orientation after backing up. In actual machine algorithms, accommodations for misfeeds, as well as for documents in the input tray which do not feed, would be made.

In both embodiments, a thickness sensor is employed along with the ultrasonic sensor to more accurately characterize the documents. Separation parameters are chosen based on predicted document characteristics, as determined by thickness and ultrasonic measurements. With both methods, the initial, or original, separation parameters can either be built into the apparatus, or custom selected by the operator through operator interface with the apparatus.

The invention has been described in detail with particular reference to certain preferred embodiments thereof, but it will be understood that variations and modifications can be effected within the scope of the invention. While preferred embodiments of the invention have been described using specific terms, this description is for illustrative purposes only. It is intended that the doctrine of equivalents be relied upon to determine the fair scope of these claims in connection with any other person's product which fall outside the literal wording of these claims, but which in reality do not materially depart from this invention.

| PARTS LIST | |
|---|---|
| 10. | Feeding and separating device |
| 11. | Printer |
| 12. | Input tray |
| 13. | Media adjustment guides |
| 14. | Urging rollers |
| 15. | Urging roller case |
| 16. | Information display window |
| 17. | User input buttons |
| 18. | Output stack support |
| 19. | Feed roller |
| 20. | Feed roller clutch |

-continued

| PARTS LIST | |
|---|---|
| 21. | Feeder drive gears |
| 22. | Separation roller |
| 23. | Separation roller door |
| 24. | Separation roller drive motor |
| 25. | Takeaway shaft/roller |
| 26. | Ultrasonic sensor |
| 27. | Thickness sensor |
| 29. | Microprocessor |
| 30. | Extended memory |
| 31. | Drive mechanism |
| 32. | Interruption mechanism |

What is claimed is:

1. A feeding and separating device for consistently separating an outermost sheet of media from a stack and feeding it to an imaging rendering apparatus, the feeding and separating device comprising:

a) a sheet transport mechanism;

b) a feed mechanism for feeding sheets to the sheet transport mechanism, the feed mechanism being positioned so as to frictionally engage the outermost sheet of the stack to advance the sheet toward the sheet transport mechanism, the feed mechanism comprising a feed roller;

c) a separation mechanism positioned adjacent to the feed mechanism, the separation mechanism comprising a separation roller;

d) at least one drive mechanism in operable association with the feed or separation mechanisms for transmitting a drive force to the feed or separation roller, and comprising a feed or separation roller direction reversal mechanism for reversing the direction of the feed or separation roller;

e) a plurality of different types of sensor devices for measuring characteristics of the sheet or sheets being fed, at least one of the sensor devices being positioned adjacent to the feed roller;

f) a microprocessor in operable communication with the sensor devices for comparing and recording measurements, and the feed or separation roller direction reversal mechanism;

wherein, depending on input from the sensor devices, the microprocessor automatically outputs to the feed or separation roller direction reversal mechanism to address feed-related problems encountered during operation;

wherein the feed or separation roller direction reversal mechanism is a mechanism for interrupting the drive connection to the feed roller; and wherein the microprocessor recognizes a feed problem through input from the sensor devices, and signals the drive connection interruption mechanism, which halts the feed roller, whereupon continued rotation of the adjacent separation roller drives the feed roller in a reverse direction.

2. A feeding and separating device according to claim 1 further comprising:

g) memory in operable association with the microprocessor for retaining such measurements.

3. A feeding and separating device according to claim 2 further comprising an information display screen for communicating information to the operator; wherein, when the microprocessor inputs to the information display screen, a pre-determined message is displayed, and, when one or more input buttons are depressed, pre-determined commands for altering operation are inputted to the processor.

4. A feeding and separating device according to claim 1 wherein the feed or separation roller direction reversal mechanism is a separate reverse drive mechanism in operable association with the separation or feed roller and the microprocessor.

5. A feeding and separating device according to claim 4 wherein the microprocessor recognizes resolution of the multiple feed problem by reading input from the sensor devices detecting the presence of a single sheet, and automatically halts the reverse drive mechanism, and re-commences the primary drive mechanism.

6. A feeding and separating device according to claim 1 wherein at least one sensor device is an ultrasonic sensor, which is positioned adjacent to the feed roller.

7. A feeding and separating device according to claim 6 wherein at least one sensor device is a thickness sensor positioned adjacent to at least one ultrasonic sensor.

8. A feeding and separating device according to claim 6 wherein the drive mechanism is connected to a clutch mechanism for transmitting an intermittent drive force to at least one roller.

9. A feeding and separating device according to claim 1 wherein, where the feed-related problem is not resolved after repeated returns of the misfed or mulitple sheets to the input tray, the microprocessor signals an alarm within the apparatus to sound or a message to be displayed in the information display screen.

10. A feeding and separating device according to claim 1 wherein the microprocessor automatically recognizes resolution of the multiple feed or misfeed through continued input from the sensor devices, and signals the drive connection interruption mechanism, which restores the drive connection and re-commences rotation of the feed roller.

11. A feeding and separating device according to claim 1 wherein the microprocessor is programmable to re-adjust the pre-determined parameters based on input over time from the sensor devices.

* * * * *